US005393485A

United States Patent [19]

Wörz et al.

[11] Patent Number: 5,393,485

[45] Date of Patent: Feb. 28, 1995

[54] PROCESS FOR THE PRODUCTION OF FOAMABLE METAL ELEMENTS

[75] Inventors: Helmut Wörz, Brixlegg; Hans P. Degischer, Salzburg, both of Germany

[73] Assignee: Mepura Metallpulvergesellschaft M.G.H., Ranshofen, Austria

[21] Appl. No.: 51,397

[22] Filed: Apr. 23, 1993

[51] Int. Cl.[6] ..... B22F 3/00

[52] U.S. Cl. ..... 419/41; 75/415; 419/23; 419/2; 419/29

[58] Field of Search ..... 419/41, 67, 23, 2, 29; 425/79, 75; 75/415

[56] References Cited

U.S. PATENT DOCUMENTS

| | | | |
|---|---|---|---|
| 2,937,938 | 5/1960 | Fiedler et al. | 75/415 |
| 3,087,807 | 4/1963 | Allen | 75/20 |
| 4,552,520 | 11/1985 | East et al. | 425/79 |
| 4,601,325 | 7/1986 | Maddock | 164/476 |
| 4,732,551 | 3/1988 | East et al. | 425/79 |
| 5,015,438 | 5/1991 | Ashok et al. | 419/23 |
| 5,151,246 | 9/1992 | Baumeister et al. | 419/2 |

FOREIGN PATENT DOCUMENTS

| | | |
|---|---|---|
| 0219019 | 3/1986 | European Pat. Off. . |
| 1248935 | 11/1960 | France . |
| 1164102 | 2/1964 | Germany . |
| 59-183927 | 4/1983 | Japan . |
| 2015035 | 2/1979 | United Kingdom . |

*Primary Examiner*—Donald P. Walsh
*Assistant Examiner*—John N. Greaves
*Attorney, Agent, or Firm*—Sixbey, Friedman, Leedom & Ferguson

[57] ABSTRACT

A process for the production of foamable elements, in which a metal powder is mixed with a foaming agent powder, the powder mixture is brought to an elevated temperature in a receiver and is extruded through a die, so that the extruded part can be subsequently foamed by decomposition of the foaming agent powder by heating of the extruded part and then cooled to yield a finished foam element. The powder mixture is continuously introduced into a channel, leading to the die, which has a moving wall component by which the powder mixture is transported in the channel by friction with precompacting and is extruded through the die. The speed of the wall component is selected so that the heating necessary for the precompacting comes from heat generated in the transport operation.

9 Claims, 1 Drawing Sheet

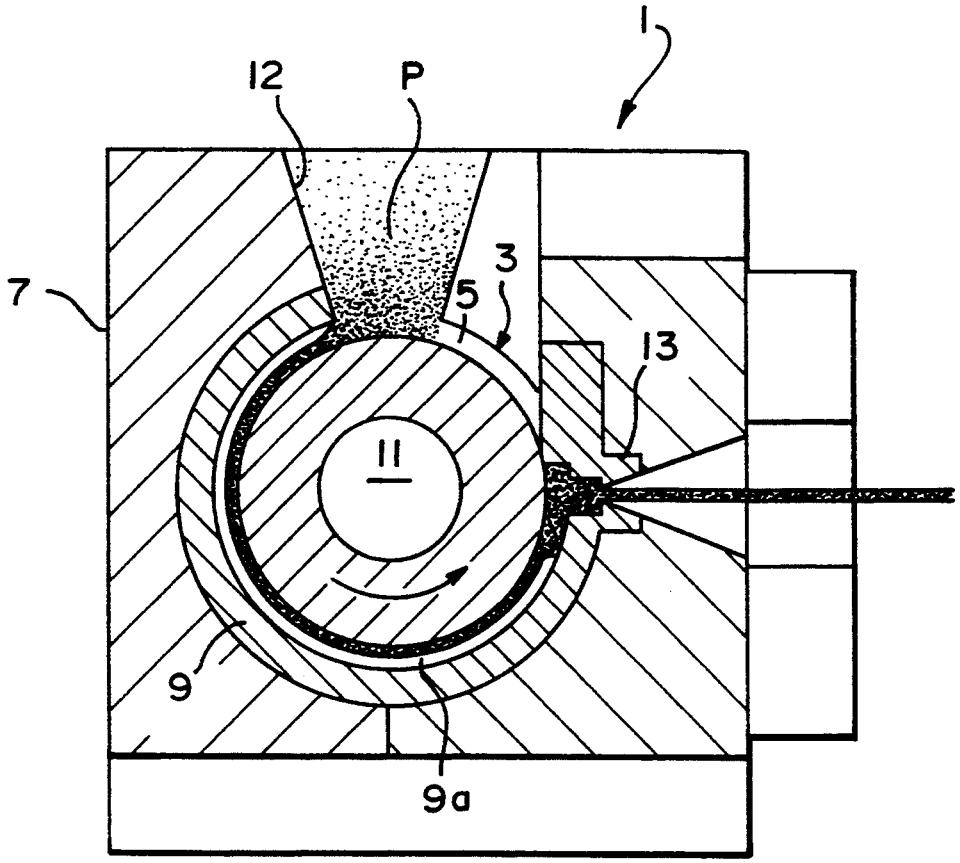
1
12
P
7
3
5
13
11
9
9a

PROCESS FOR THE PRODUCTION OF FOAMABLE METAL ELEMENTS

BACKGROUND OF THE INVENTION

1. Field of the Invention

The invention relates to a process for the production of metal foam elements in which a metal powder is mixed with a gas-producing foaming agent powder. More specifically, where the powder mixture is brought to an elevated temperature in a vessel and is extruded through a die, the extruded part being subsequently foamed by heating with decomposition of the foaming agent powder, and then is cooled to produce a finished foam element.

2. Description of Related Art

A process of the initially-mentioned type is known from U.S. Pat. No. 3,087,807. In this known process, a preferably pre-compacted mixture of a metallic powder (preferably aluminum powder) and a gas-producing foaming agent powder (preferably zirconium hydride or calcium carbonate) is poured batchwise, i.e., in a measured amount, into a cylindrical cavity and extruded therefrom through the opening of a die by a ram. The material to be extruded contained in the cavity is, in this case, brought to a temperature suitable for extrusion by resistance heating or induction heating.

Disadvantages of this known process are that the length of the extrudate is limited and that even in the preparation of the amount of powder to be extruded, the latter has to be measured corresponding to the desired length of the extrudate. In this connection, the capacity of the cylindrical cavity sets an upper limit on the size of the product that can be produced and permits only relatively short extruded parts to be obtained, especially if it is desired to dispense with precompacting of the powder.

SUMMARY OF THE INVENTION

The primary object of the present invention is to provide a process of the initially mentioned type with which extrudates of any length can be produced in a simple way.

This object is achieved according to a preferred embodiment of the invention by a process in which the powder mixture is introduced continuously into a channel leading to the extrusion die, the channel having a wall component moving toward the die. By means of the moving wall component, the powder mixture is transported in the channel by friction with precompacting and is extruded through the die with a degree of deformation of at least 5 to 1. Additionally, the speed of the moving wall component is selected so that the heating necessary for the precompacting comes from the heat generated in the transporting operation.

In this way, a continuous flow of material to the die is attainable, so that extrudates of any length can be obtained. Simultaneously, the friction by the sliding of the powder over the stationary parts of the channel walls and the slipping of the powder on the transporting parts of the channel walls insures that, during transportation of the material to the extrusion die, sufficient heat is generated for the reshaping during extrusion, and so that the metal powder particles begin to connect in a way enclosing the powder particles of the foaming agent, without any additional heating, such as the induction heating in the process according to U.S. Pat. No. 3,087,807, being required.

These and further objects, features and advantages of the present invention will become apparent from the following description when taken in connection with the accompanying drawings which, for purposes of illustration only, show an embodiment in accordance with the present invention.

BRIEF DESCRIPTION OF THE DRAWING

The sole figure of the drawing is a cross-sectional view of an apparatus for performing the method of the present invention.

DETAILED DESCRIPTION OF THE PREFERRED EMBODIMENTS

With reference to the sole figure, a device 1 for performing a continuous extrusion process in accordance with the present invention can be seen. The extrusion device 1, comprises a grooved wheel 3, comparable in shape to the shape (not necessarily the dimensions) of a belt pulley and an approximately a U-shaped groove 5 is provided on its periphery. Wheel 3 rotates in a cylindrical interior space of a housing 7, so that the surfaces of the wheel which define groove 5 form a moving surface component of a channel, which is bounded by the walls of the wheel 3 defining groove 5 together with a stationary surface component 9, which has an arcuate pressure anvil portion 9*a* which projects into the U-shaped groove 5.

With powders being used as the starting materials, the rotating shaft 11 of the grooved wheel 5 and the axis of the cylindrical inner space are horizontal, as shown, and feeding of the metal and foaming agent powders takes place from above through a hopper or hopper-shaped inlet 12 at the top of the housing 7. The stationary pressure anvil portion 9*a* of the surface component 9 extends around, for example, up to 270° of the circumference of the wheel 3, from the inlet 12 atop the housing 7 to die 13, in the direction of rotation of the grooved wheel; however, when less heating and compaction is required, a surface component 9 could be used which, relative to the figure, extends 90° in a clockwise direction to the die 13 and the wheel 3 would rotate in a clockwise direction instead of the counterclockwise direction indicated by the arrow thereon.

The powder mixture P, which is precompacted as it is transported in the channel from the inlet 12, and is deflected into extrusion die 13, which extends approximately radially outwardly relative to the arcuate extent of stationary surface component 9. The slaving of the powder mixture in the channel takes place by friction between the rotating grooved wheel 3 and the powder mixture. By the relative movements occurring here, between the surface of the wheel 3 defining the groove 5 and the powder particles, and also the powder particles amongst themselves, the mentioned heating and precompacting of the powder mixture takes place before it is extruded by the die.

The speed of rotation of the grooved wheel 3 is also important to achieving the heat generated during transport and also the precompacting resulting. In this connection, the heat generated and the friction processes occurring are, in this case, dependent on the speed with which the movable wall component moves toward the die 13. The higher this speed, the higher the speed difference between the moving wall and the powder mixture in the die, and thus, the higher the generated temperature, but also the greater the precompacting of the powder mixture before it passes through the die, which counteracts premature decomposition of the foaming agent by enclosing the powder particles of the foaming agent with the metal powder.

In this way, foaming agents are also usable which, at normal pressure, have a relatively low decomposition temperature, and surprisingly, it turns out that, in principle, a wall speed can be obtained in which the resulting temperature and the pressure build-up are matched to one another so that, on the one hand, advantageous temperature conditions are present for the precompacting and, on the other hand, an undesirable decomposition of the foaming agent in this phase does not take place. The compression pressure build-up and the temperature resulting in this case depend, of course, also on the resistance of the extrusion die, i.e., also on the degree of deformation brought about by the extrusion die. This degree of deformation, expressed as a ratio of input cross section to output cross section, should be at least 5:1, preferably at least 8:1, if for no other reason than that, otherwise, above all in the core of the extrudate, no sufficiently solid compound of the metal powder particles is achieved so that, in heating the extruded part to foaming, the gas generated with the foaming agent can volatilize in areas and the necessary subsequent foaming does not take place in the areas lacking the foaming agent due to outgassing thereof of during the extrusion process. In the above-indicated range for the ratio of input cross section to output cross section, suitable ratios of compression and temperature can also be achieved upstream of the extrusion die.

With the use of aluminum powder and titanium hydride, grain sizes of the powder of less than or equal to 3000 μm, preferably less than or equal to 600 μm, most preferably less than or equal to 300 μm, are advantageous.

An advantageous mixing ratio of the metal alloy with titanium hydride as a foaming agent has been found to be 0.1 to 1.0% by weight, preferably 0.3–0.4% by weight of titanium hydride, with the remainder aluminum or an aluminum alloy.

In the case of a circular cross section of the extruded part of a 9.5 mm diameter, the output speed in an embodiment was about 20 m/min, which is approximately equivalent to 200 kg/h of foamable material based on aluminum.

It has been shown, as mentioned, that a sufficient heating and compression can always be achieved to also allow foaming agents, which have a low decomposition temperature at normal pressure, not to degas prematurely. In individual cases, cooling could also be considered, in addition, if for no other reasons than to enable a higher speed of transport, which otherwise would produce too great a heating, to be obtained. The maximum temperature on the inside of the die should not exceed 550°–600° C. when aluminum or an aluminum alloy is used.

Typical diameters for the grooved wheel 3 are at 300–600 mm. However, these dimensions for the wheel 3 should be understood as not being limiting.

Besides aluminum or aluminum alloys, powders of iron, copper and nickel as well as their alloys are also useable.

Until now, it has been the practice to use a piece of an extrudate for an element to be foamed. But in many cases, for example in elements which are to be used as absorbers for impact energy (crush zones of motor vehicles), it has proven suitable and advantageous and without any drawback by possibly present inside interfaces, to produce the element from several pieces, for example, from the extrudate chopped into granular material or from a skein or bundle of extruded wire. This makes possible a great flexibility in dosage and arrangement of the foamable material in molds in which they are to be foamed. Drawbacks by possibly present inside interfaces therefore do not result, since such elements being used as shock absorbers remain in one form (e.g., a foil) and are never under tension.

While various embodiments in accordance with the present invention have been described, it is understood that the invention is not limited thereto, and is susceptible to numerous changes and modifications as known to those skilled in the art. For example, the apparatus shown in the drawing is not critical to performance of the inventive process, and those skilled in the art will be aware of other conventional apparatus that can be adapted to performance of the applicants' method of extruding foamable metal elements made from the disclosed powder constituents. Likewise, it should be appreciated that an extruded foamable component produced by the inventive process can foamed to yield a metal foam element is in any manner known in the art to produce foaming of prior art components formed from mixtures of metal powders and a powdered foaming agent. Therefore, this invention is not limited to the details shown and described herein, and includes all such changes and modifications as are encompassed by the scope of the appended claims.

We claim:

1. Process for the production of foamable metal elements, which may be foamed by decomposition of a foaming agent due to heating, comprising the steps of continuously introducing a powder mixture, of a metal powder with a foaming agent powder, into a channel leading to an extrusion die; bringing the powder mixture to an elevated temperature and precompacting before it is extruded through the die by utilizing a moving channel wall surface component to frictionally transport the powder mixture to the die; and extruding the powder mixture through the die with a degree of deformation of at least 5 to 1; wherein the speed of the moving channel wall surface component is selected so that heating necessary for the precompacting comes from heat generated by the frictional transport step.

2. Process according to claim 1, wherein aluminum or an aluminum alloy is used as the metal powder of said powder mixture.

3. Process according to claim 2, wherein said metal powder has an average particle size of 600 μm or less.

4. Process according to claim 2, wherein said metal powder has an average particle size of 300 μm or less.

5. Process according to claim 4, wherein titanium hydride is mixed with the metal powder in said powder mixture in an amount of 0.3 to 0.4% by weight.

6. Process according to claim 1, wherein titanium hydride is mixed with the metal powder in said powder mixture in an amount of 0.3 to 0.4% by weight.

7. Process according to claim 1, wherein said channel is arcuately shaped; wherein said transporting step is performed utilizing a rotating wheel having a peripheral groove, the surfaces of the wheel defining said groove forming said moving channel wall surface component; and wherein said peripheral groove is closed by a stationary channel wall component.

8. Process according to claim 7, wherein said stationary channel wall component comprises an arcuate pressure anvil member which projects into the peripheral groove of the wheel.

9. Process according to claim 8, wherein the precompacted and heated powder mixture is extruded through said die in a radial direction with respect to said rotating wheel.

* * * * *